US006755610B2

(12) United States Patent
Wolters et al.

(10) Patent No.: US 6,755,610 B2
(45) Date of Patent: Jun. 29, 2004

(54) SIDE-CHANNEL PUMP HAVING AN END COVER COMPOSED OF A CERAMIC DISC INTEGRATED WITH A CHANNELLED PLASTIC UNIT

(75) Inventors: Stefan Wolters, Möchengladbach (DE); Egbert Neugebauer, Mönchengladbach (DE); Michael Rombach, Neuss (DE)

(73) Assignee: Ti Automotive (Neuss) GmbH, Neuss (DE)

( * ) Notice: Subject to any disclaimer, the term of this patent is extended or adjusted under 35 U.S.C. 154(b) by 26 days.

(21) Appl. No.: 10/325,175

(22) Filed: Dec. 20, 2002

(65) Prior Publication Data

US 2003/0133784 A1 Jul. 17, 2003

(30) Foreign Application Priority Data

Jan. 11, 2002 (DE) ..... 102 00 791

(51) Int. Cl.[7] ..... F04D 5/00
(52) U.S. Cl. ..... 415/55.1
(58) Field of Search ..... 415/55.1, 55.2, 415/55.3, 55.4, 55.5, 55.6, 55.7, 215.1

(56) References Cited

U.S. PATENT DOCUMENTS 5,472,321 A 12/1995 Radermacher ..... 417/365
6,095,771 A * 8/2000 Schelhas et al. ..... 417/423.14
6,435,810 B1 * 8/2002 Fischer et al. ..... 415/55.1
6,454,521 B1 * 9/2002 Anderson et al. ..... 415/55.1

FOREIGN PATENT DOCUMENTS

| | | |
|---|---|---|
| DE | 9634253 | 7/1997 |
| DE | 9704403 | 8/1998 |
| DE | 197 04 403 | 8/1998 |

* cited by examiner

*Primary Examiner*—Edward K. Look
*Assistant Examiner*—Richard A. Edgar
(74) *Attorney, Agent, or Firm*—Ladas & Parry

(57) ABSTRACT

A side channel pump having a housing, a pump mechanism including an impeller in the housing to pump liquid from an inlet of the pump to an outlet of the pump, and first and second end cover members on opposite sides of the impeller, at least one of the cover members having a side channel therein for flow of the liquid from the inlet to the outlet. The cover member is made as an assembly of a ceramic body and a plastic unit. The ceramic body has a slot therein into which the plastic inlet is fitted. The plastic unit has an open channel facing the impeller to form the side channel of the pump and the side channel tapers in cross-section from the inlet to the outlet.

23 Claims, 2 Drawing Sheets

SIDE-CHANNEL PUMP HAVING AN END COVER COMPOSED OF A CERAMIC DISC INTEGRATED WITH A CHANNELLED PLASTIC UNIT

FIELD OF THE INVENTION

The invention relates to a side-channel pump and particularly to end covers which close opposite axial ends of the pump and provide the side channels therefor.

Such a side-channel pump has a housing, a drive means and at least one pump mechanic which pumps liquid from an inlet of the pump mechanism to the outlet of the pump mechanism, the pump mechanism including opposite end covers with side-channels and a rotatable impeller between the end covers. The impeller has blade rims in both axial walls that are joined together and each end cover has a side channel that tapers in the running direction of the impeller.

BACKGROUND AND PRIOR ART

Such a side-channel pump is disclosed in DE 197 04 403 A1 which has means to improve pump efficiency and reduce noise generation. In this respect, the impeller is made of an injection-molded plastic with a metal reinforcement.

A pump is also disclosed in DE 196 34 253 A1 which has a ceramic disc between the impeller and the side-channel cover, in which a disc slot is made that corresponds to the shape of the spiral side channel. The side channel is completed by a recess provided in the end cover. The ceramic disc has the disadvantage that it is subject to inaccuracies due to shrinkage of the ceramic material during the manufacturing process. This prevents precise production which leads to variations in the cross-sectional surface of the side channel. Hence, a cross-sectional surface that is optimal for good efficiency cannot be precisely achieved without expensive post-processing operations. However, according to the citation the ceramic material is desirable for the disc since it decreases the wear between the side-channel cover and the impeller. Otherwise, the service life of the side-channel pump could be adversely affected.

Thus, there is a need for measures that are suitable for mass production, which reduce the fluctuations in the cross-sectional surface of the side channel without increasing the wear between the side-channel cover and the impeller.

SUMMARY OF THE INVENTION

This object is achieved in side-channel pumps of the type described above by making the end cover as a composite structure of a ceramic disc and a plastic unit, the ceramic disc being provided with a slot in which the plastic unit is fitted and includes the side channel.

In an advantageous embodiment, the ceramic disc has a peripheral shoulder facing away from the impeller and the plastic unit has a flange seated at the shoulder on the ceramic disc.

In an alternative embodiment, the plastic unit is integrally joined to the pump housing.

In accordance with the invention, the ceramic disc is smooth on the surface facing the impeller and is rough on all of the other surfaces, particularly the surface facing away from the impeller. Advantageously, the surface of the ceramic disc that faces the impeller is made smooth by honing or lapping. The functionally adapted form of the side channel is obtained by making the side channel in the plastic unit tapered in its cross section by reducing the width and/or depth of the side channel. It is also advantageous if the plastic unit is comprised of a non-swelling, form-stable plastic.

If a part of the plastic unit completely or partially occupies the peripheral shoulder provided in the ceramic disc, this is advantageous, in that the thickness of the part of the plastic unit that projects into the peripheral shoulder is small in comparison to the thickness of the ceramic disc.

It is possible to combine the advantages of ceramic and plastic materials by means of this invention for a side-channel pump by separating the functions required for the side-channel cover respectively by the ceramic disc and the plastic unit. The composite structural unit can thus be used also for direct bearing support of the drive shaft without additional components, due to the properties of the plastic material.

The requirements with respect to manufacturing accuracy for the slot in the ceramic disc are not particularly high, since the slot is occupied by the plastic unit. Since the side of the ceramic disc facing the impeller is made smooth, for example, by honing or lapping, the advantage of little wear is maintained. For a high resistance to wear of the side-channel pump, it is recommended to form the plastic unit of thermosetting or thermoplastic material. The wear between the side-channel cover and the impeller is thus minimized.

Because the surfaces of the ceramic disc are rough, with the exception of the surface facing the impeller, they permit the plastic unit that is injection molded onto the ceramic disc, to bind particularly effectively with the ceramic disc. Stability is considerably improved by providing the ceramic disc with suitable means at the periphery on the side facing the impeller, for example, teeth, shoulders, etc. Then, the peripheral flange of the plastic unit can engage the peripheral shoulder at the outer periphery of the ceramic disc, so that the ceramic disc is completely attached in the plastic unit. In this way, it is possible to arrange the thus formed side-channel cover in the side-channel pump, such that an axial force is not absolutely necessary in order to hold the ceramic disc and the plastic unit together.

The shape of the side channel in the plastic unit can be formed with high accuracy during the injection-molding process by an appropriately shaped tool, whereby the accuracy of the side channel is considerably improved. The fluctuations in the cross-sectional surface of the side-channel in the prior art construction thus will be clearly reduced.

The production of the side-channel pump by means of this procedure is particularly suitable for mass production, since processing steps that are time-consuming and expensive can be omitted. The cross-sectional tapering of the side channel is formed during the injection-molding process with high accuracy by modifying the width and/or depth of the channel in the plastic unit so that subsequent processing is unnecessary. The ceramic disc only involves its basic shape and thus is simple to produce.

DETAILED DESCRIPTION

Figure 1:
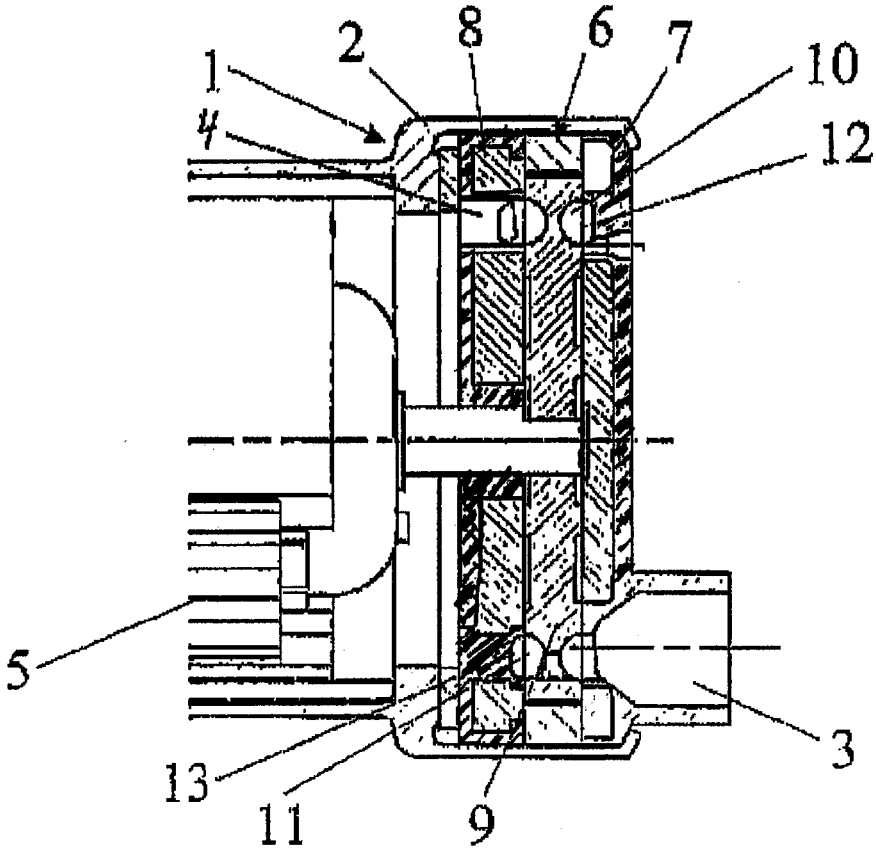
FIG. 1 is a side sectional view of a side-channel pump according to the invention.

Referring to FIG. 1, therein is seen a side-channel pump 1 having a housing 2 in which an impeller 9 of a pump mechanism 6 is rotatably supported for pumping liquid from an inlet 3 of the pump to an outlet 4 of the pump. In the case in which the side-channel pump is utilized as a fuel pump for an internal combustion engine, the pumped liquid is a fuel. The impeller 9 is driven by a drive mechanism 5 in conventional manner. The pump mechanism includes end covers 7 and 8 on opposite sides of the impeller 9 and form side channels therewith for transport of the liquid from the inlet to the outlet. The outlet 4 is arranged so that the pumped liquid washes and cools the drive mechanism 5. The illustrated side channel pump 1 is a two stage pump having two blade rims 10 and 11.

The end covers 7 and 8 form side channel base units having respective side channels 12 and 13 for liquid flow from the inlet to the outlet. The liquid entering the inlet 3 is pumped to a higher pressure by impeller 9 through the side channels to the outlet 4. Up to this point, the pump construction is conventional.

Figure 2:
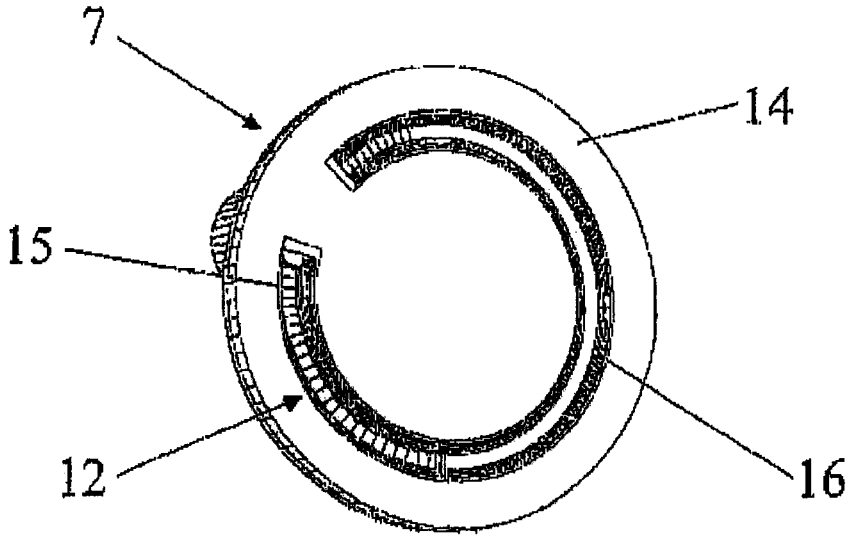
FIG. 2 is a perspective view of a side-channel cover member.

FIG. 2 is a perspective view of end cover 7 which is constructed in accordance with the invention. End cover 8 is of similar construction but houses the drive shaft of the impeller 9 as seen in FIG. 1.

FIG. 2 shows end cover 7 formed by a ceramic disc 14 in which is fitted a plastic unit 15 defining side channel 12. The ceramic disc 14 is provided with a spiral slot 16 extending over less than the entire circumference of the disc. The plastic unit 15 is fitted substantially flush in slot 16 and is provided with an open channel forming the side channel of the pump mechanism. The open channel in the plastic unit has a tapering cross-section in the pumping direction of the impeller and the tapering cross-section is achieved by a gradual reduction in the depth of the open channel. The precision of manufacture of the slot 16 is not critical as any inaccuracies are compensated by the plastic unit which fills the slot. Thereby, the manufacturing precision of side channels 12 and 13 is peripheral but not the manufacturing precision of slot 16 for the efficiency of the side-channel pump.

Figure 3:
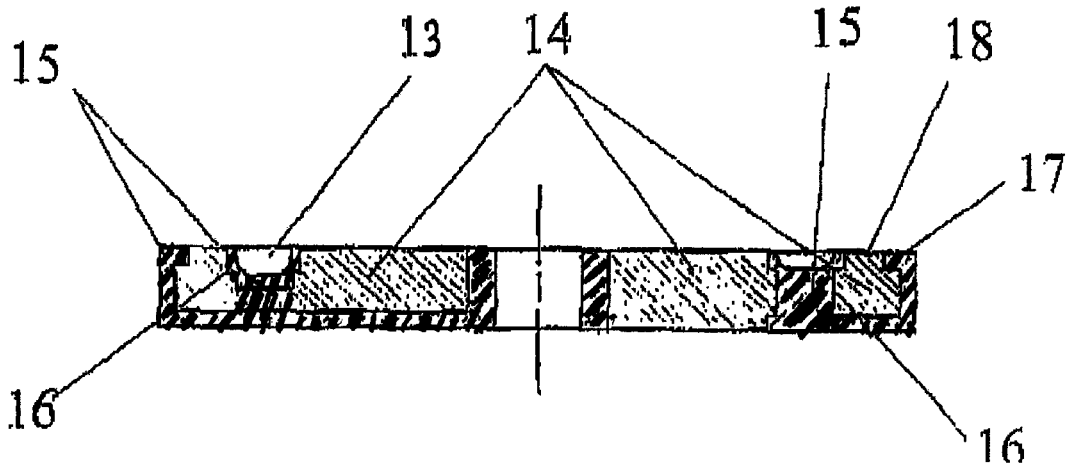
FIG. 3 is a sectional view of one of the cover members of the side-channel pump.

The arrangement of the plastic unit 15 and ceramic disc 14 is shown in FIG. 3 where it is seen how the plastic unit 15 forms the side channel 13 in slot 16. The plastic unit 15 can be very precisely produced in a particularly simple manner by injection molding with an appropriately shaped tool. In this embodiment, as previously explained, the tapering of the cross section of side channel 13 is achieved by a reduction of its depth as seen by the smaller depth of side channel 13 on the right side as compared to the left side. The transport of the liquid through the pump mechanism 6 is achieved by sliding of transport blades (not shown) of the impeller 9 over side channel 13 in conventional manner. Since the impeller 9 and its transport blades are in direct contact with surface 18 of the ceramic disc, it is of decisive importance for resistance to wear that the surface 18 is made particularly smooth. This is achieved, for example, by honing or lapping surface 18. In contrast, the remaining surfaces of the ceramic disc 14 are left relatively rough in order to enhance the connection between the ceramic disc 14 and the plastic unit 15.

As seen in FIG. 3, the plastic unit 15 penetrates through slot 16 and covers the back surface of ceramic disc 14 and forms a peripheral flange which extends around the outer periphery of the ceramic disc 14 and is seated in a peripheral shoulder 17 formed at the periphery of the disc 14 facing away from the impeller. This provides a secure attachment of the ceramic disc 14 in the plastic unit 15. Essentially, the ceramic disc 14 becomes embedded in the plastic unit 15 with its surface 18 exposed for travel of the impeller blades thereon.

The end cover can be formed as a separate unit which is secured to the housing 2 of the pump or the plastic unit 15 of the end cover can be integrally molded with the housing 2. As seen in FIG. 1 the inlet 3 is integrally formed with end cover 7.

Although the invention is disclosed with reference to a particular embodiments thereof, it will become apparent to those skilled in the art that numerous modifications and variations can be made which will fall within the scope and spirit of the invention as defined by the attached claims.

What is claimed is:

1. A side channel pump comprising a housing, a pump mechanism including an impeller in said housing to pump liquid from an inlet of the pump to an outlet of the pump, a drive means connected to said pump mechanism, and first and second end cover members on opposite sides of said impeller, at least one of said cover members having a side channel therein for flow of the liquid from the inlet to the outlet, said at least one of said cover members comprising an assembly of a ceramic body and a plastic unit, said ceramic body having a slot therein, said plastic unit being fitted in said slot and having an open channel in said slot facing the impeller to form said side channel, said open channel in said plastic unit tapering in cross-section from said inlet to said outlet.

2. The side channel pump of claim 1, wherein said ceramic body has a peripheral edge with a shoulder formed thereat at a side of the ceramic body facing away from the impeller, said plastic unit being seated at said shoulder.

3. The side channel pump of claim 1, wherein said plastic unit is integral with said housing.

4. The side channel pump of claim 1, wherein said inlet is an integral component of said plastic unit.

5. The side channel pump of claim 1, wherein the ceramic body has a surface facing the impeller, said surface being smooth while remaining surfaces of the ceramic body are rough.

6. The side channel pump of claim 1, wherein the other of said first and second cover members also has a side channel and comprises another assembly of a ceramic body and a plastic unit.

7. The side channel pump of claim 1, wherein said slot in the ceramic body extends circumferentially.

8. The side channel pump of claim 1, wherein said ceramic body is of disc shape.

9. The side channel pump of claim 1, wherein said plastic unit is injection molded to embed said ceramic body therein with a surface of the ceramic body exposed and facing said impeller.

10. The side channel pump of claim 9, wherein the surface of the ceramic body facing said impeller is made smooth by honing or lapping.

11. The side channel pump of claim 9, wherein said exposed surface of the ceramic body and the plastic unit are substantially flush with one another.

12. The side channel pump of claim 1, wherein said slot extends through said ceramic body and said plastic unit extends through said slot and on a back surface of said cover member.

13. The side channel pump of claim 12, wherein said plastic unit has a peripheral flange which covers a peripheral surface of said ceramic body.

14. An end cover for a side channel pump adapted to face a pump impeller and form a side channel of the pump, said end cover comprising an assembly of a ceramic body and a plastic unit, said ceramic body having a slot therein, said plastic unit being fitted in said slot and being provided with an open channel in said slot for facing towards the impeller to form the side channel of the pump, said open channel in the plastic unit having a tapered cross-section from one end of the open channel to an opposite end of the open channel.

15. The end cover of claim 14, wherein the open channel has a depth which tapers from said one end of the open channel to the opposite end of the open channel.

16. The end cover of claim 14, wherein said smooth surface is lapped or honed.

17. The end cover of claim 14, wherein said plastic unit is form-stable and resistant to swelling when contacted by fuel.

18. The end cover of claim 14, wherein the ceramic body has a peripheral shoulder and said plastic unit has a peripheral flange seated at said shoulder.

19. The end cover of claim 14, wherein said plastic unit is injection molded to embed the ceramic body therein while leaving a surface exposed for travel of the impeller thereon.

20. The end cover of claim 14, wherein the ceramic body is of disc shape and said slot is circumferential.

21. The end cover of claim 20, wherein the plastic unit extends through the slot and onto a back surface of the ceramic disc and includes a circumferential flange which engages around an outer peripheral surface of the ceramic disc.

22. The end cover of claim 14, wherein the ceramic body has a surface for travel of the impeller thereon, said surface being smooth.

23. The end cover of claim 22, wherein the ceramic body except for said smooth surface is rough.

* * * * *